US009899759B2

(12) United States Patent
Yu et al.

(10) Patent No.: US 9,899,759 B2
(45) Date of Patent: Feb. 20, 2018

(54) POWER CONNECTOR

(71) Applicant: ALLTOP ELECTRONICS (SUZHOU) LTD., Taicang, JiangSu Province (CN)

(72) Inventors: Wang-I Yu, New Taipei (TW); I-Hung Cheng, New Taipei (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/345,663

(22) Filed: Nov. 8, 2016

(65) Prior Publication Data

US 2017/0194733 A1 Jul. 6, 2017

(30) Foreign Application Priority Data

Dec. 31, 2015 (TW) ..... 104221391 U

(51) Int. Cl.
*H01R 13/428* (2006.01)
*H01R 12/72* (2011.01)
*H01R 13/115* (2006.01)

(52) U.S. Cl.
CPC ..... *H01R 13/428* (2013.01); *H01R 12/724* (2013.01); *H01R 13/115* (2013.01)

(58) Field of Classification Search
CPC .. H01R 24/60; H01R 12/724; H01R 2107/00; H01R 13/6205; H01R 13/516; H01R 13/6471; H01R 13/6594; H01R 12/7076; H01R 12/716; H01R 12/91; H01R 13/03; H01R 13/113; H01R 13/14; H01R 13/26
See application file for complete search history.

(56) References Cited

U.S. PATENT DOCUMENTS 3,199,066 A * 8/1965 Eledge ..... H01R 12/716 439/636
4,383,724 A * 5/1983 Verhoeven ..... H01R 31/08 439/510
5,681,190 A * 10/1997 Childs ..... H01R 13/11 439/842
5,941,741 A * 8/1999 Dobbelaere ..... H01R 13/113 439/852
6,905,373 B2 * 6/2005 Wu ..... H01R 13/11 439/746
7,112,105 B2 * 9/2006 Wu ..... H01R 13/11 439/746

(Continued)

*Primary Examiner* — Truc Nguyen
(74) *Attorney, Agent, or Firm* — Sughrue Mion, PLLC

(57) ABSTRACT

A power connector for electrically connecting with a complementary connector includes an insulating housing defining a number of channels and a number of pairs of power contacts received in corresponding channels. Each pair of power contacts has a pair of oppositely arranged two power contacts. Each power contact is provided with a retaining portion fixed within the channel, a contacting portion extending from one end of the retaining portion and a tail portion extending from the other end of the retaining portion. The contacting portion is formed with a first contacting finger and a second contacting finger, which are side-by-side positioned. The first contacting finger defines a first contacting area and the second contacting finger defines a second contacting area. The first and the second contacting areas are extending within a same plane.

17 Claims, 17 Drawing Sheets

(56) References Cited

U.S. PATENT DOCUMENTS

| | | | | |
|---|---|---|---|---|
| 7,731,550 | B2 * | 6/2010 | Falchetti | H01R 13/113<br>439/843 |
| 8,613,626 | B1 * | 12/2013 | Phan | H01R 13/11<br>439/181 |
| 2002/0098743 | A1 * | 7/2002 | Schell | H01R 13/055<br>439/850 |

* cited by examiner

POWER CONNECTOR

BACKGROUND

1. Technical Field

The present disclosure relates to an power connector, and more particularly to a power connector mounting onto a printed circuit board.

2. Description of Related Art

Power connectors used in electronic devices, such as routers and switches, carry high currents to a printed circuit boards housed within the device. Generally, more efficient contacting area and enhanced thermal properties for the power contacts are two typical problems when designing a power connector carrying high current.

Hence, there is a need to provide an improved power connector.

SUMMARY

The present disclosure discloses a power connector for electrically connecting with a complementary connector. The power connector comprises an insulating housing defining a plurality of channels and a plurality of pairs of power contacts received in corresponding channels. Each pair of power contacts comprises a pair of oppositely arranged two power contacts. Each power contact is provided with a retaining portion fixed within the channel, a contacting portion extending from one end of the retaining portion and a tail portion extending from the other end of the retaining portion. The contacting portion is formed with a first contacting finger and a second contacting finger which are side-by-side positioned. The first contacting finger defines a first contacting area and the second contacting finger defines a second contacting area. The first and the second contacting areas are extending within a same plane.

The present disclosure also discloses a power connector comprising an insulating housing defining a plurality of channels extending therethrough, and a plurality of power contacts housed within the insulating housing. Each power contact comprises a contacting portion, a retaining portion for secured to the insulating housing, and a tail portion extending perpendicularly to the contacting portion. The plurality of power contacts are arranged in pairs, each pair of power contacts retained in one corresponding channel and having corresponding contacting portions confronting to each other. Each contacting portion is provided with a first contacting area and a second contacting area. The first contacting area and the second contacting area arranged along a front-to-back direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
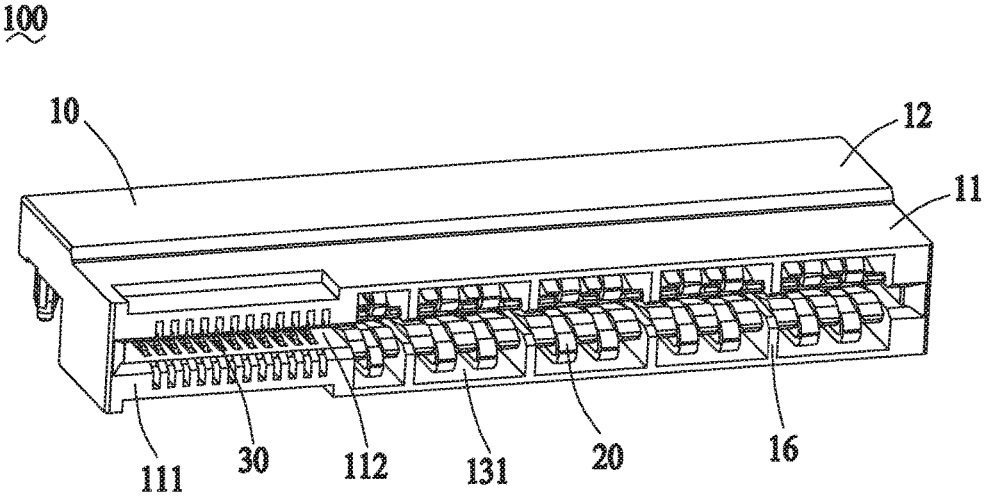
FIG. 1 is a perspective view of a power connector of a first embodiment in accordance with the present invention.

Reference will now be made to the drawing figures to describe the embodiments of the present disclosure in detail. In the following description, the same drawing reference numerals are used for the same elements in different drawings.

Referring to FIGS. 1 to 7, an illustrated first embodiment of the present invention discloses an power connector 100. The power connector 100 is employed to mounted onto a printed circuit board (not shown) and engages with a complementary connector (not shown). The power connector 100 includes an insulating housing 10, a plurality of pairs of power contacts 20 and pairs of signal contacts 30 received in said insulating housing 10, and a spacer 40 for positioning the pairs of signal contacts 30.

Figure 2:
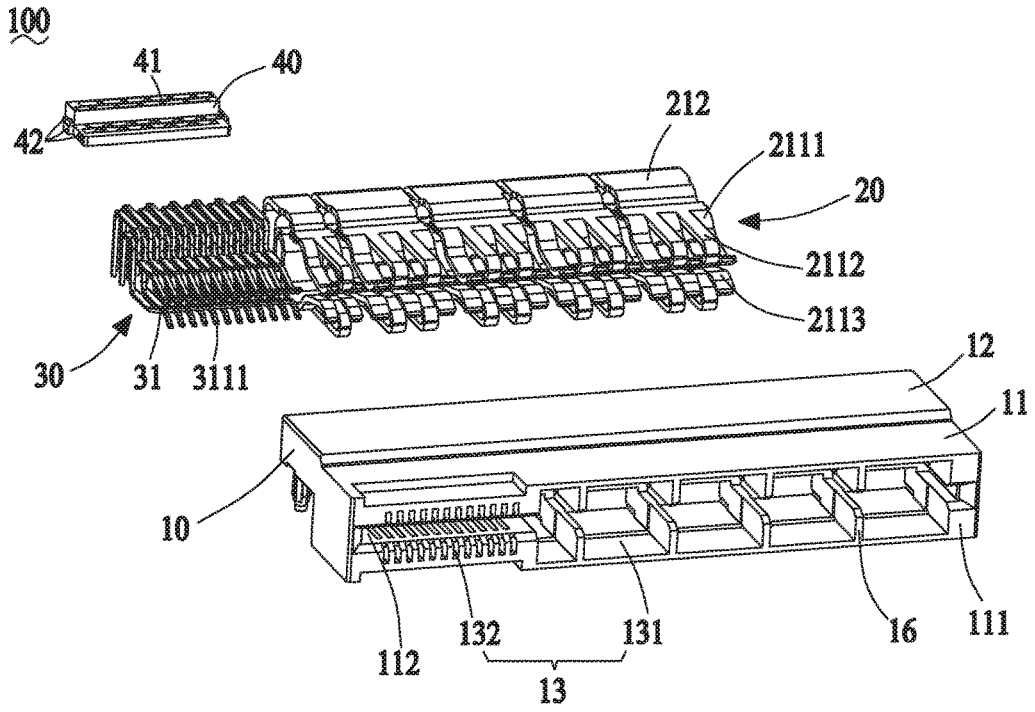
FIG. 2 is an exploded, perspective view of the power connector as shown in FIG. 1.
Figure 3:
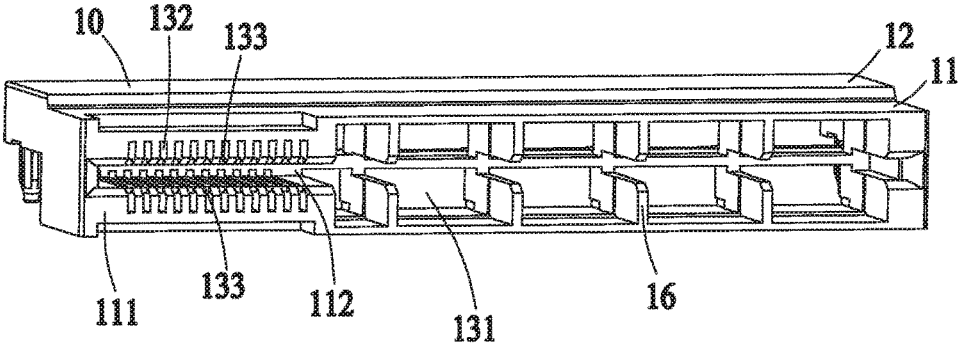
FIG. 3 is a perspective view of an insulating housing as shown in FIG. 2.
Figure 4:
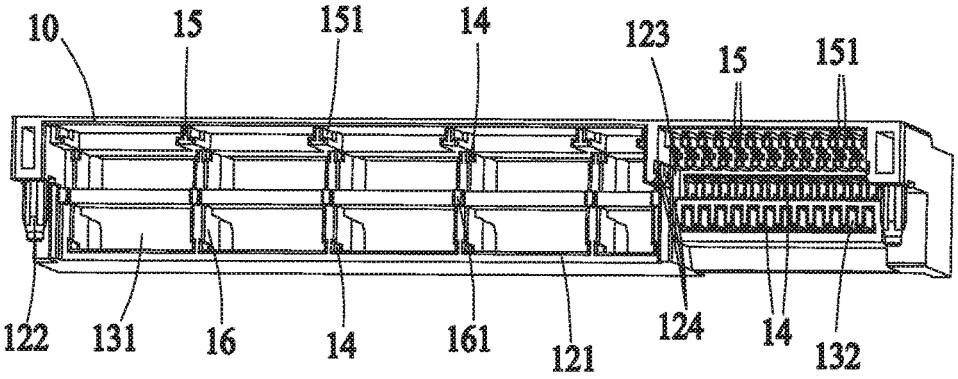
FIG. 4 is a perspective view of the insulating housing as shown in FIG. 3 while taken from a different aspect.
Figure 5:
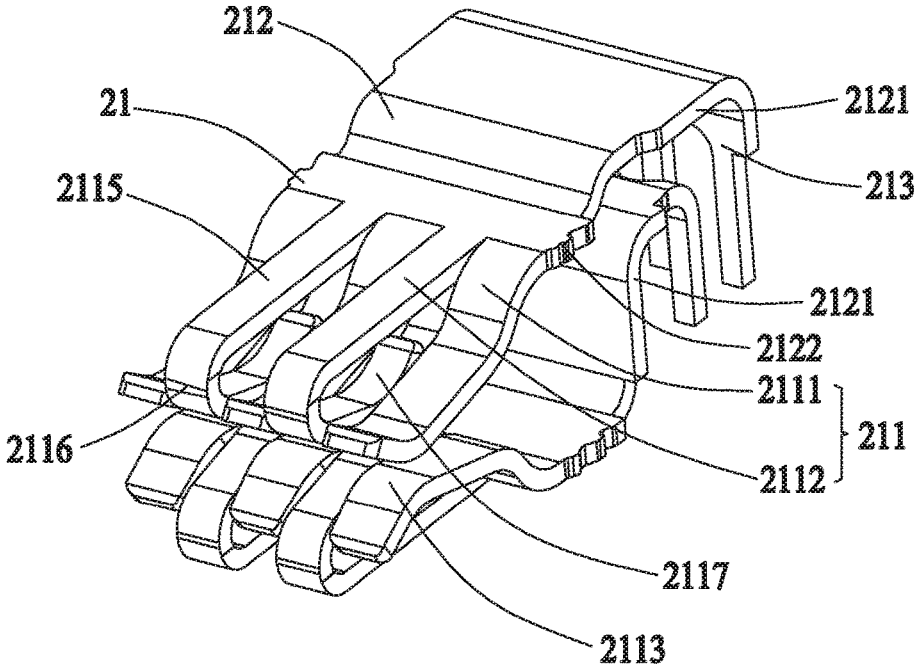
FIG. 5 is a perspective view of a pair of power contacts as shown in FIG. 2.
Figure 6:
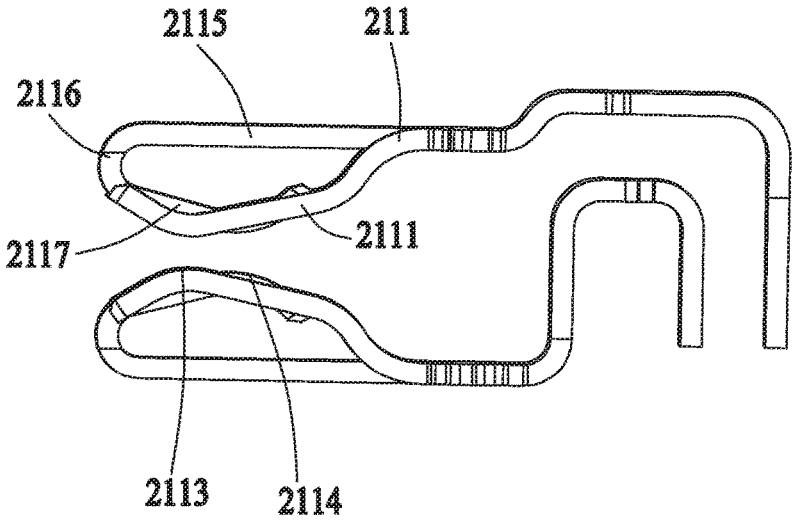
FIG. 6 is a side view of the power contacts as shown in FIG. 5.

Referring to FIGS. 3 and 4 together with FIG. 2, the insulating housing 10 comprises a mating section 11, a mounting section 12 and a plurality of channels 13 extending through the mating section 11 and the mounting section 12. A mating face 111 is provided at a front end of the mating section 11. A mounting face 121 is provided at a rear end of the mounting section 12 which is opposite to the mating face 111. The channels 13 extend from the mating face 111 to the mounting face 121. The channels 13 includes a plurality of first channels 131 for receiving the pairs of power contacts 20 and a plurality of second channels 132 for receiving the pair of signal contacts 30. The configurations of the first and the second channels 131, 132 are different from each other due to different configurations of the power contact 20 and the signal contact 30.

The mating section 11 defines a mating space 112 in the front thereof for receiving the complementary connector.

The mating space 112 communicates with the channels 13. Each channel 13 is formed by two opposite inner sidewalls 16 and defines two side recesses 14 in a rear end of the two inner sidewall 16, respectively. The inner sidewall 16 is also performed as a separating wall separating two neighbored channels 13. A row of blocks 15 are provided on the mounting section 12, each of which defines two slits 151 at opposite sides thereof. Similarly, each separating wall 16 can be deem as having two side recesses 14 formed therewith. A plurality of protrusions 161 are provided on the mounting section 12. From a back view, the block 15, the protrusion 161 and the separating wall 16 are positioned in a line. The mounting section 12 have a pair of posts 122 extending downwards therefrom for mounting onto the printed circuit board.

Together referring to FIGS. 3 to 6, each pair of power contacts 20 includes two oppositely arranged power contacts 21. Each power contact 21 comprises a retaining portion 212 fixed within the first channel 131, a contacting portion 211 extending from one end of the retaining portion 212 and a tail portion 213 from the other end of the retaining portion 212. Two opposite edges of the retaining portion 212 are formed with a side protrusion 2121 and barbs 2122. The side protrusion 2121 is close to the tail portion 213 and the bards 2122 are close to the contacting portion 211. In one pair of power contacts 20, the barbs 2122 are fixed within the side recesses 14 with the side protrusion 2121 of one power contact 21 retained in the slit 151 and the side protrusion 2121 of the other power contact 21 retained between the two separating walls 161. Therefore, the pair of power contacts 20 are firmly received in the first channels 131, but also an undesired displacement of the power contacts 20 is prohibited.

In the preferred embodiment, the contacting portion 211 is formed with a plurality of first contacting fingers 2111 and a plurality of second contacting fingers 2112. The first and the second contacting fingers 2111, 2112 are arranged side by side. The first contacting fingers 2111 define a first contacting area 2113 and the second contacting fingers 2112 define a second contacting area 2114. The first contacting area 2113 and the second contacting area 2114 are staggered from each other along a front-to-back direction. The first contacting area 2113 extends within a first plane and the second contacting area 2114 extends within a second plane. As can be understood, the first plane and the second plane can be the same plane in this preferred embodiment.

The second contacting finger 2112 comprises a forwards projecting portion 2115, a backwards projecting portion 2117 and a curved portion 2116 connecting the forwards projecting portion 2115 and the backwards projecting portion 2117. The second contacting area 2114 is formed on the backwards projecting portion 2117. The first contacting finger 2111 extends substantially in a V-shape. The backwards projecting portion 2117 of the second contacting finger 2112 extends substantially in a V-shape. The employment of the first contacting area 2113 and the second contacting area 2114 makes a larger contacting area when the current passes through the power contact 21. There is a slit formed between the first contacting finger 2111 and the backwards projecting portion 2117 to avoid interference therebetween. A width of the first contacting area 2113 of the first contacting finger 2111 is reduced along a front-to-back direction. A width of the second area 2114 of the second contacting finger 2112 is reduced along a back-to-front direction. Understandably, if there is a need in other embodiments, the widths of the first and the second contacting areas can be designed to be equal to each other.

Figure 7:
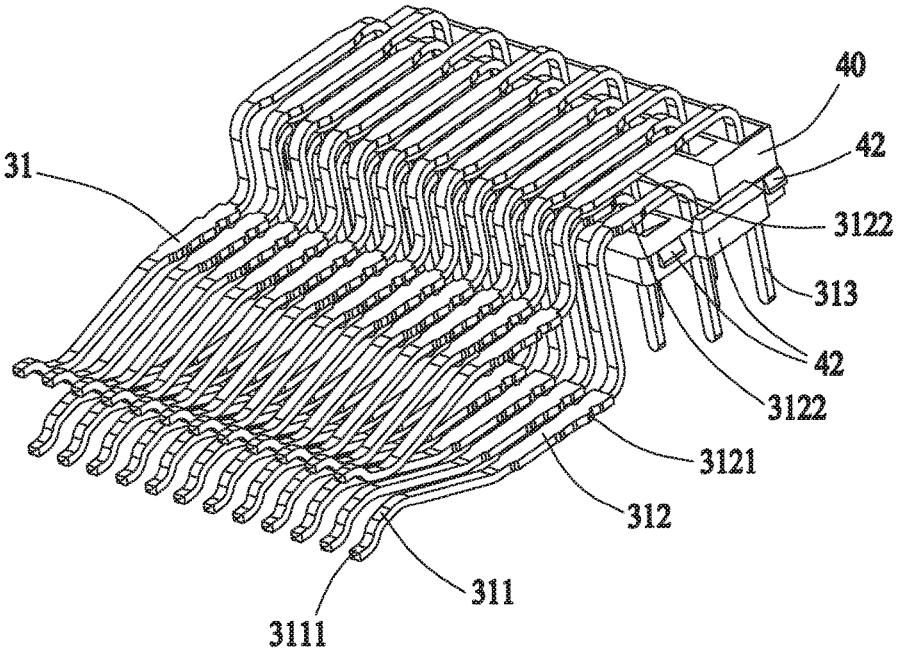
FIG. 7 is a perspective view of a subassembly of signal contacts and a spacer as shown in FIG. 2.
Figure 8:
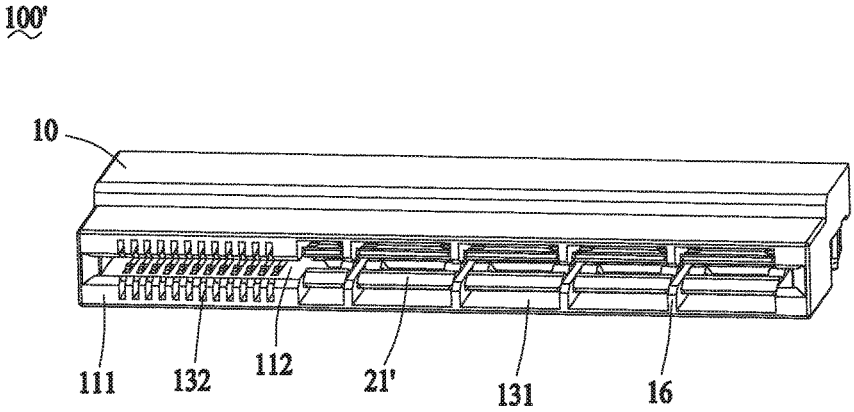
FIG. 8 is a perspective view of the power connector of a second embodiment.
Figure 9:
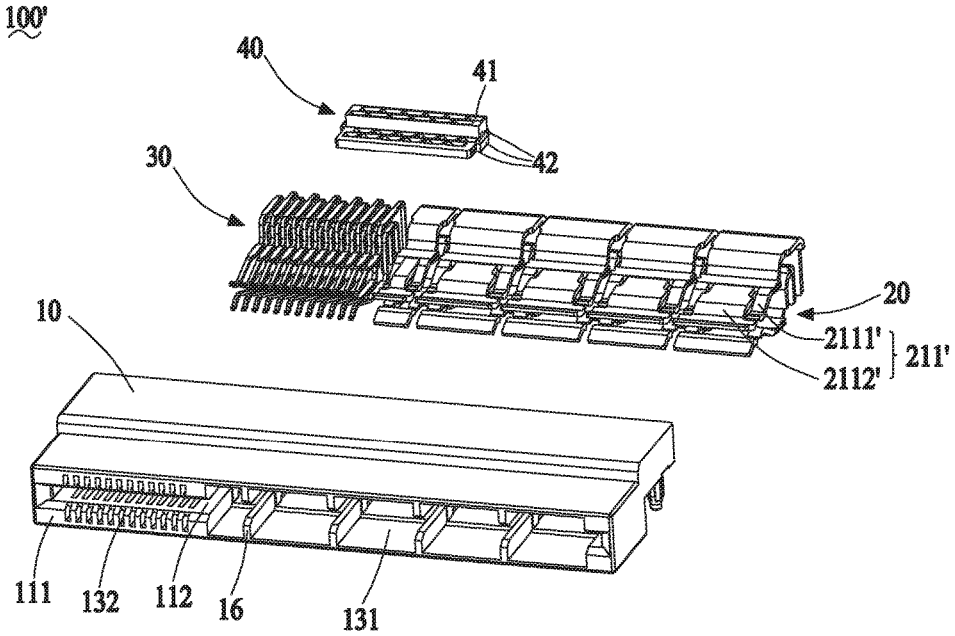
FIG. 9 is an exploded, perspective view of the power connector of FIG. 8.
Figure 10:
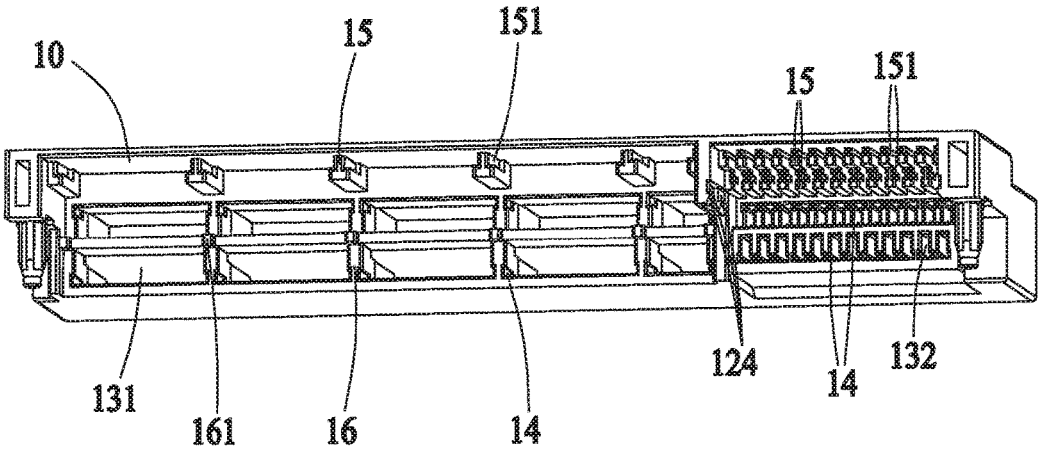
FIG. 10 is a perspective view of the insulating housing of FIG. 9.
Figure 11:
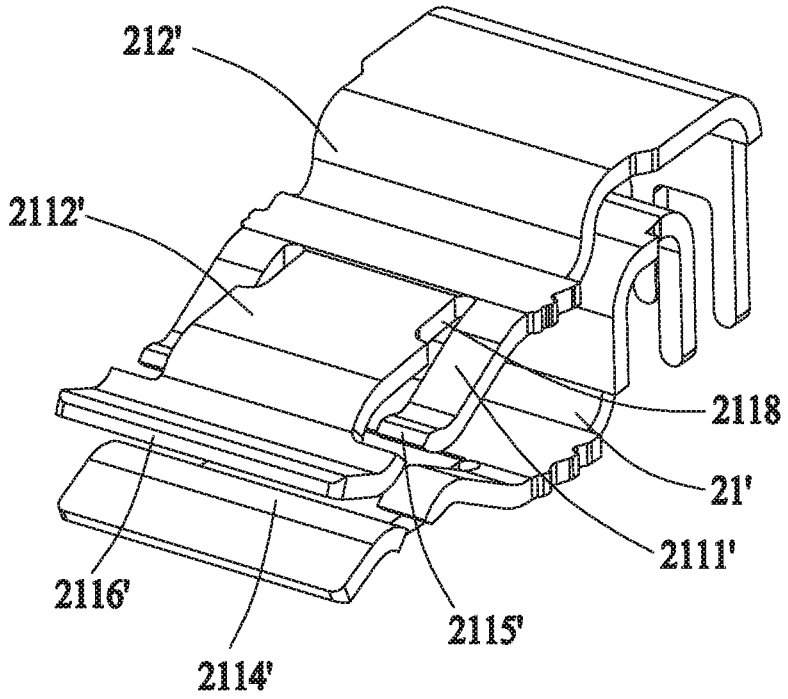
FIG. 11 is a perspective view of a pair of power contacts of FIG. 9.

Turn to FIG. 7 together with FIGS. 3 and 4, each pair of signal contacts 30 includes two opposite positioned signal contacts 31. Each signal contact 31 comprises an inserting portion 312, an engaging portion 311 projecting from one end of the inserting portion 312 and a distal end 313 projecting from the other end of the inserting portion 312. The inserting portion 312 provides a barb 3121 and an embossment 3122 along two opposite side edges thereof. The barb 3121 is close to the engaging portion 311 and interfered respectively within the side recess 14. The embossment 3122 is close to the distal end 313 and retained respectively in the slit 151. The distal end 313 is received and fixed in the spacer 40. In this preferred embodiment, the distal ends 313 are arranged into four rows. The spacer 40 defines a plurality of slots 41 for inserting therethrough the distal ends 313 and two wedge blocks 42 at opposite sides thereof. The mounting section 12 defines an opening 123 for receiving the spacer 40. There are grooves 124 defined in inside faces of the opening 123 for correspondingly retaining therein the wedge blocks 42.

Referring to FIGS. 8-11, the second embodiment of the present invention is illustrated. The power connector 100' has a similar structure with the power connector 100 of the first embodiment. The main difference is in the power contact 21'.

Figure 12:
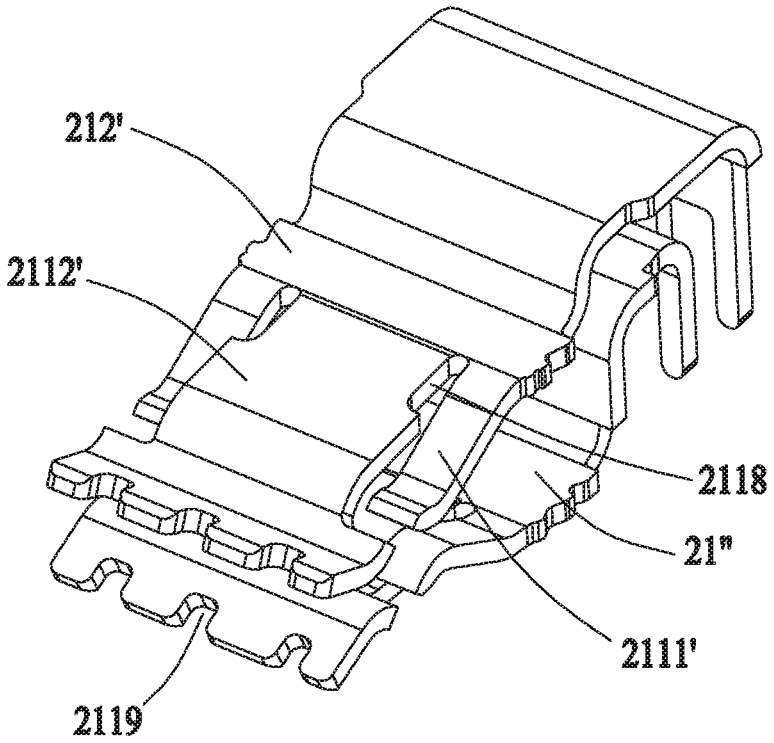
FIG. 12 is a perspective view of the pair of power contacts of FIG. 11 of another embodiment.
Figure 13:
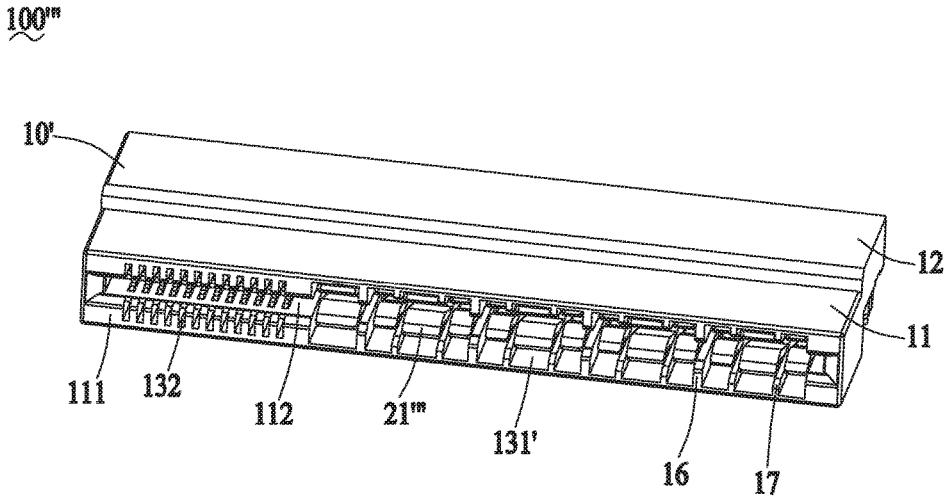
FIG. 13 is a perspective view of the power connector of a third embodiment.
Figure 14:
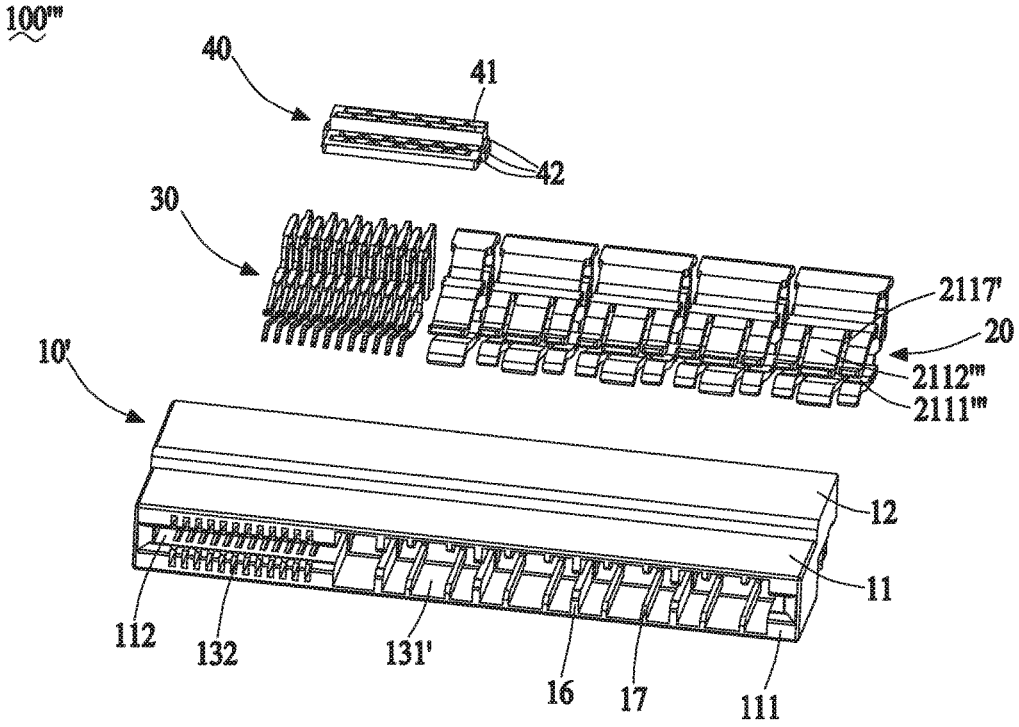
FIG. 14 is an exploded, perspective view of the power connector of FIG. 13.
Figure 15:
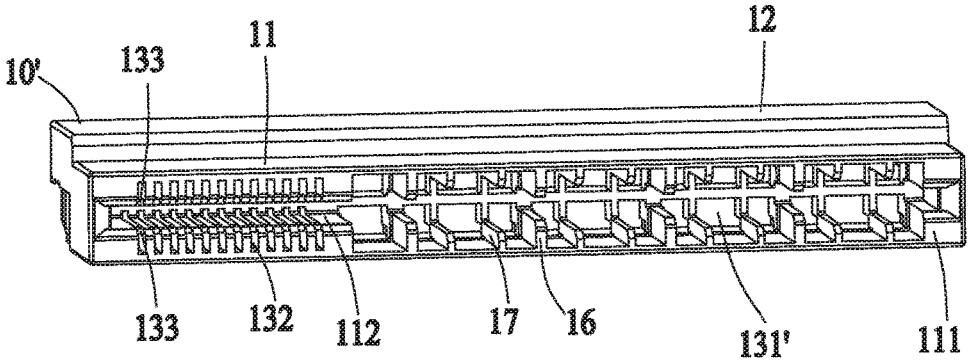
FIG. 15 is a perspective view of the insulating housing of FIG. 14.
Figure 16:
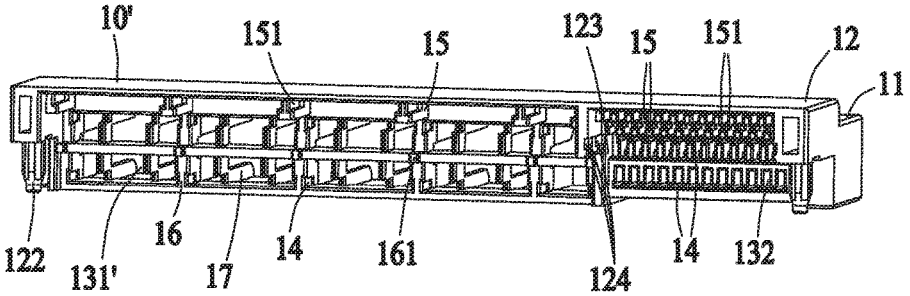
FIG. 16 is a perspective view of the insulating housing of FIG. 15 while taken from another aspect.
Figure 17:
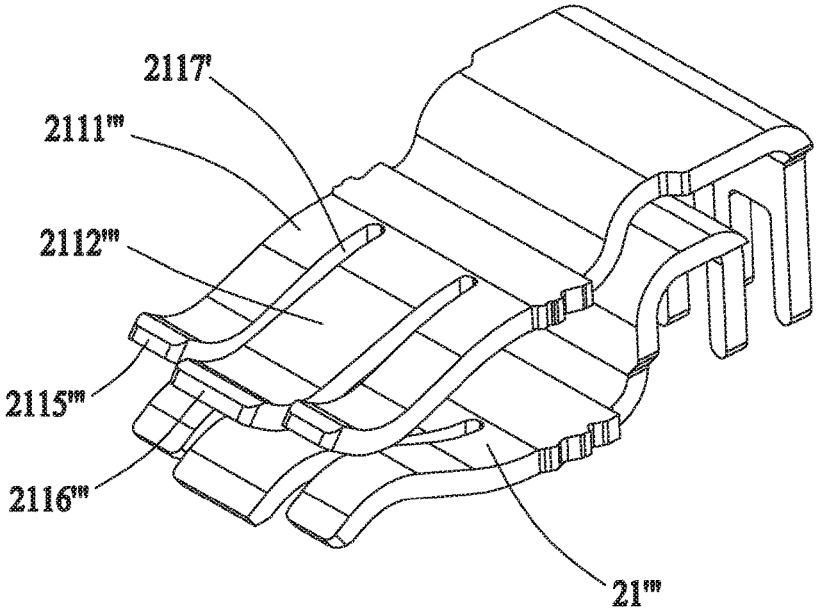
FIG. 17 is a perspective view of the pair of power contacts of FIG. 14.

In this embodiment, the both the first contacting finger 2111' and the two second contacting fingers 2112' extend as a V-shape. The length of the first contacting finger 2111' is shorter than that of the second contacting finger 2112'. A front end face 2115' of the first contacting finger 2111' is located behind the second contacting area 2114'. The front end of the second contacting finger 2112' extends transversely. The width of a front end face 2116' of the second contacting finger 2112' is same to the width of the contacting portion 211'. In other words, the second contacting finger 2112 is formed in a T-shape with a pair of first contacting fingers 2111' positioned at opposite sides thereof. The second contacting finger 2112' defines a pair of cutouts 2118 along opposite side edges thereof, which are close to the retaining portion 212' and work for heat-dissipation. Compared to the power contact 21' in FIG. 11 in accordance with the second embodiment, in FIG. 12, a plurality of grooves 2119 are defined in the front edge of the second contacting finger 2112' of the power contact 21" for heat-dissipation purpose.

Referring to FIGS. 13-17, the third embodiment of the present invention of the power connector 100''' is illustrated. The main differences are in the structure of the power contacts 21''' and the insulating housing 10'. The length of the first contacting finger 2111''' is shorter than the length of the second contacting finger 2112'''. A front end face 2115''' of the first contacting finger 2111''' is located behind a front end face 2116''' of the second contacting finger 2112'''. A slit 2117' is formed between the first and the second contacting fingers 2111''', 2112'''. A plurality of middle protrusions 17 are formed in each of the first channel 131' for isolating the first contacting fingers 2111''' and the second contacting fingers 2112'''.

The contacting portion of the electrical power connector of the present invention is divided into first contacting fingers and the second contacting fingers with the first contacting area being therefore formed on the first contacting fingers and the second contacting area being formed on the second contacting fingers. The two staggered arranged contacting areas provide a relatively larger contacting area when the current passes through the power contact, which reduce the heat generated from the contact resistance.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A power connector for electrically connecting with a complementary connector, comprising:

an insulating housing defining a plurality of channels throughout a mating face and a mounting face opposite to said mating face; and a plurality of pairs of power contacts received in corresponding channels, each pair of power contacts comprising a pair of oppositely arranged two power contacts, each power contact provided with a retaining portion fixed within said channel, a contacting portion extending from one end of said retaining portion and a tail portion extending from the other end of said retaining portion;

wherein said contacting portion is formed with at least one first contacting finger and at least one second contacting finger, said at least one first contacting finger defining a first contacting area and said at least one second contacting finger defining a second contacting area; and wherein said first contacting area and said second contacting area are arranged along a front-to-back direction;

wherein said second contacting finger comprises a forwards projecting portion, a backwards projecting portion and a curved portion connecting said forwards projecting portion and said backwards projecting portion, and wherein said second contacting area is defined on said backwards projecting portion and a slit is defined between said first contacting finger with said backwards projecting portion.

2. The power connector as claimed in claim 1, wherein said at least one first contacting finger and said at least one second contacting finger extend oppositely to each other.

3. The power connector as claimed in claim 2, wherein said first contacting finger extends substantially in a V-shape and said backwards projecting portion of said second contacting finger extends substantially in a V-shape.

4. The power connector as claimed in claim 1, wherein a width of said first contacting area in said first contacting finger is reduced along a front-to-back direction.

5. The power connector as claimed in claim 1, wherein a width of said second contacting area in said second contacting finger is reduced along a back-to-front direction.

6. The power connector as claimed in claim 1, wherein said insulating housing comprises a mating section with said mating face at a front end thereof and a mounting section with said mounting face, and wherein said mating section defines a mating space in the front thereof for receiving the complementary connector, said mating space communicating with said channels.

7. The power connector as claimed in claim 6, further comprising a plurality of signal contacts which are arranged in pairs, wherein each signal contact comprises an inserting portion, an engaging portion projecting from one end of said inserting portion and a distal end projecting from the other end of said inserting portion.

8. The power connector as claimed in claim 7, further comprising a spacer for positioning said signal contacts, wherein said spacer is assembled to said mounting section of said insulating housing.

9. The power connector as claimed in claim 1, wherein each power contact has at least two first contacting fingers arranged at opposite sides of said at least one second contacting finger.

10. The power connector as claimed in claim 9, wherein said at least one second contacting finger is formed in a substantial T-shape.

11. The power connector as claimed in claim 9, wherein a width of a front end of the second contacting finger is same to the width of the contacting portion.

12. The power connector as claimed in claim 6, wherein each channel is formed by two opposite separating walls and defines two side recesses in said two separating walls, respectively.

13. The power connector as claimed in claim 12, wherein a plurality of blocks and a plurality of protrusions are provided on said mounting section, and wherein said block, said protrusion and said separating wall are positioned in a line.

14. A power connector, comprising an insulating housing defining a plurality of channels extending therethrough, and a plurality of power contacts housed within said insulating housing, each power contact comprising a contacting portion, a retaining portion for secured to said insulating housing, and a tail portion extending perpendicularly to the contacting portion, said plurality of power contacts arranged in pairs, each pair of power contacts retained in one corresponding channel and having corresponding contacting portions confronting to each other, each contacting portion provided with a first contacting area and a second contacting area, said first contacting area and said second contacting area arranged along a front-to-back direction;

wherein said contacting portion is formed with at least two first contacting fingers and at least two second contacting fingers, said first contacting area formed on said at least two first contacting fingers and said second contacting area formed on said at least two second contacting fingers, and wherein said at least two first contacting fingers and said at least two second contacting fingers are arranged side by side.

15. The power connector as claimed in claim 14, wherein said contacting portion is formed with at least two first contacting fingers and at least one second contacting finger, said first contacting area formed on said at least two first contacting fingers and said second contacting area formed on said at least one second contacting finger, and wherein said at least two first contacting fingers oppositely arranged with said at least one second contacting finger sandwiched therebetween.

16. The power connector as claimed in claim 15, wherein said at least one second contacting finger is configured in a substantial T-shape.

17. The power connector as claimed in claim 14, further comprising pairs of signal contacts received in corresponding channels of said insulating housing and a spacer cooperating with said insulating housing for positioning said pairs of signal contacts.

* * * * *